United States Patent [19]

Desjardins

[11] 4,300,471

[45] Nov. 17, 1981

[54] WALLPAPERING APPARATUS

[76] Inventor: J. C. Guy Desjardins, 107 rue Binet, Hull, Canada

[21] Appl. No.: 757,511

[22] Filed: Jan. 7, 1977

Related U.S. Application Data

[63] Continuation-in-part of Ser. No. 605,454, Aug. 18, 1975, abandoned.

[30] Foreign Application Priority Data

Oct. 1, 1974 [CA] Canada ..... 210540

[51] Int. Cl.[3] ..... B05C 1/08; B05C 3/15

[52] U.S. Cl. ..... 118/235; 118/246; 118/262; 118/419; 118/DIG. 17

[58] Field of Search ..... 118/419, DIG. 17, 246, 118/428, 420, 235, 262; 156/575

[56] References Cited

U.S. PATENT DOCUMENTS

| | | | |
|---|---|---|---|
| 931,492 | 8/1909 | Ross | 118/DIG. 17 |
| 1,351,901 | 9/1920 | Gringras | 118/419 X |
| 2,256,227 | 9/1941 | Zaccheo | 118/419 X |
| 2,348,166 | 5/1944 | Cavanaugh et al. | 118/419 X |
| 2,443,971 | 6/1948 | Winzer | 118/419 X |
| 2,458,297 | 1/1949 | Petty | 118/419 X |
| 2,574,584 | 11/1951 | Nasmith | 118/246 |
| 2,581,638 | 1/1952 | Deering | 118/419 X |
| 2,960,963 | 11/1960 | Shelton | 118/423 X |
| 3,344,770 | 10/1967 | Schaefer | 118/419 X |
| 3,669,070 | 6/1972 | Wallace | 118/419 X |

*Primary Examiner*—John P. McIntosh
*Attorney, Agent, or Firm*—A. W. Breiner

[57] ABSTRACT

An apparatus for applying wallpaper which moistens prepasted wallpaper or applies paste to unpasted wallpaper and guides the paper as it is withdrawn from the roll and applied to the wall. The apparatus includes a base for rotatably supporting a roll of wallpaper and a frame attached to the base for supporting at least one pair of rollers for guiding the wallpaper through a trough partly filled with a liquid such as water or paste. The apparatus for use with paste has one roll in the trough of paste and a further roll for transfering paste from the roll to the paper.

2 Claims, 6 Drawing Figures

WALLPAPERING APPARATUS

Figure 1A:
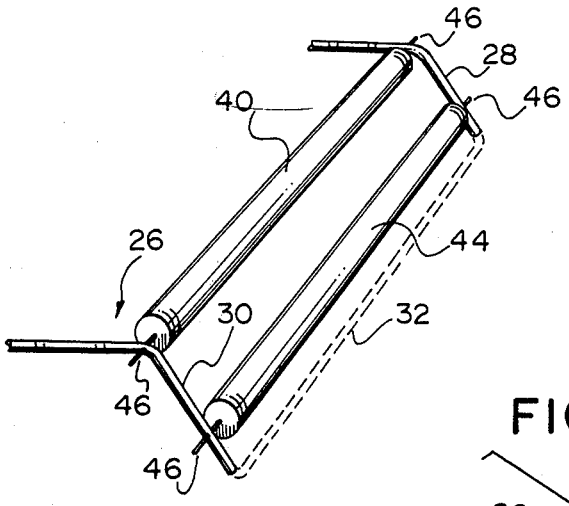

This application is a continuation-in-part of application Ser. No. 605,454 filed Aug. 18, 1975, now abandoned.

This invention relates to wall papering devices and more particularly to an apparatus for applying or moistening glue and aiding in positioning the paper as it is being applied to the wall. Known devices include a hand held apparatus containing water or paste depending upon whether or not the wall paper is pre-pasted. Aside from the fact that the device is relatively heavy to hold it is not possible to have both hands free to position and cut the wall paper.

Other devices are merely troughs having submerged bars so that pre-cut, pre-pasted wall paper can be passed through the water. In this case paper is roughly measured and cut on a table, then after the paste or glue has been moistened in the trough it is applied to the wall and the ends trimed. Depending upon the type of pattern on the paper there is usually a great deal of waste to cut off after the pattern on adjacent strips has been matched. Furthermore, it is inconvenient to carry the wet wall paper particularly for an amature who may tend to crumple or tear the paper.

Through the use of the present invention however, the apparatus including a trough is placed against the wall and the correct amount of pre-pasted wall paper is withdrawn and immediately applied to the wall. Furthermore the apparatus guides the paper so that the bottom of the strip of paper is in alignment with the previosly applied strip while the top portion is being applied.

It is therefore an object of the present invention to provide a simple and inexpensive apparatus for moistening pre-pasted paper or pasting wall paper and supplying it as required adjacent the wall to be papered.

Accordingly, the present invention provides an apparatus for applying wall paper comprising a base, spaced apart upright flanges on the base, means on the base for holding a roll of wall paper, a frame adapted to be secured to the flanges and extend into a trough positioned in front of said flanges, a first roller journaled on the frame so as to extend along an upper edge of an adjacent side wall of the trough and a second roller journaled on a portion of the frame extending into a lower portion of the trough, whereby wall paper supported for rotation on said flanges is fed over the first roller, under the second roller which is in the trough of water, the leading end of the paper being applied to the upermost portion of the wall, positioned and cut and the procedure repeated as the apparatus is moved along the wall.

Figure 1:
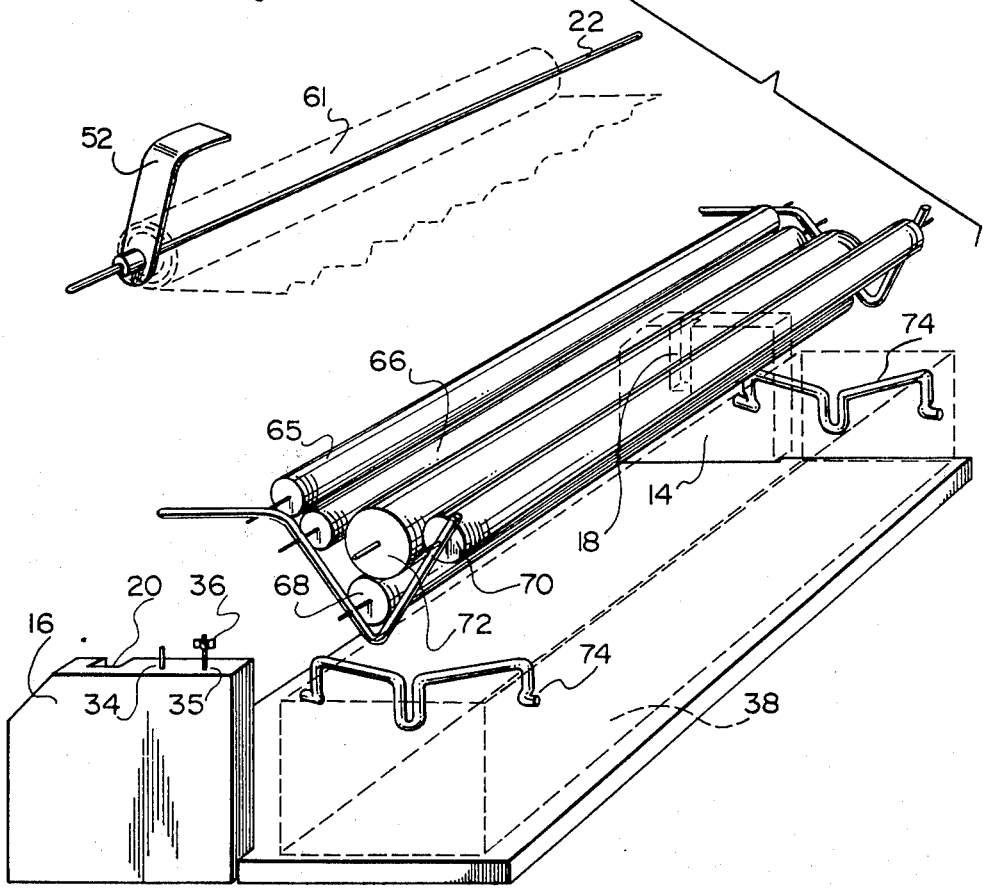
Figure 2:
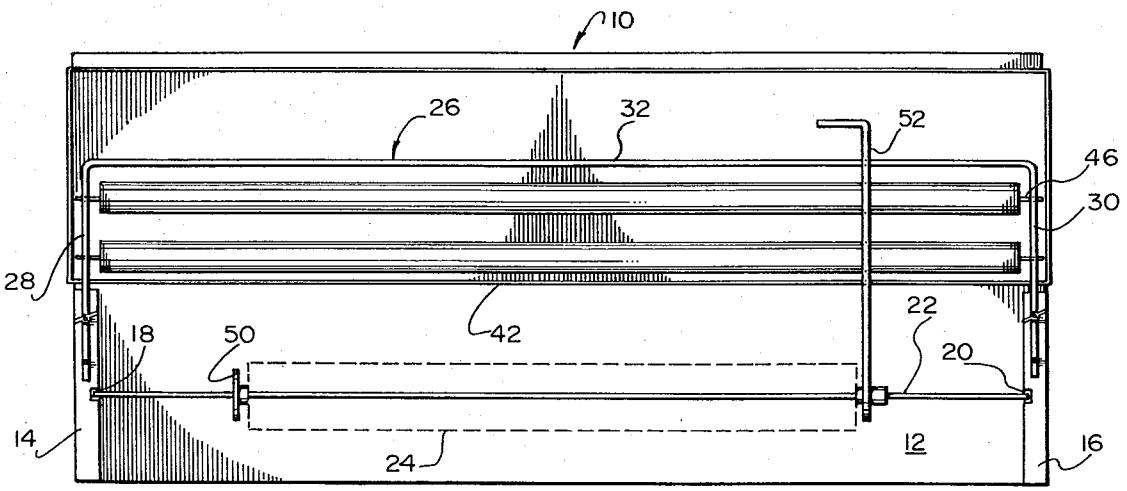
Figure 4:
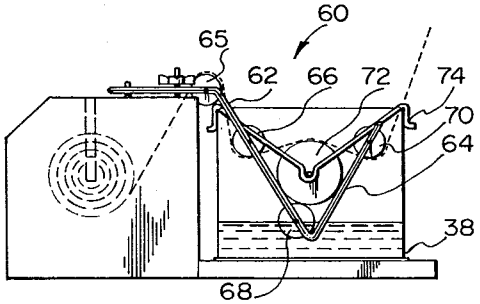
Figure 3:
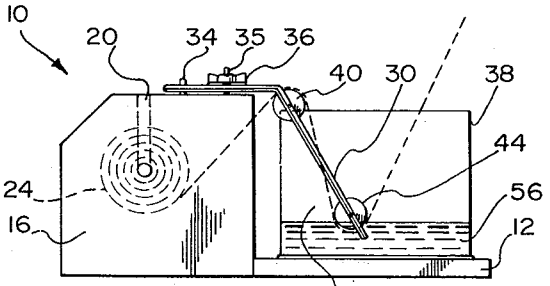
Figure 5:
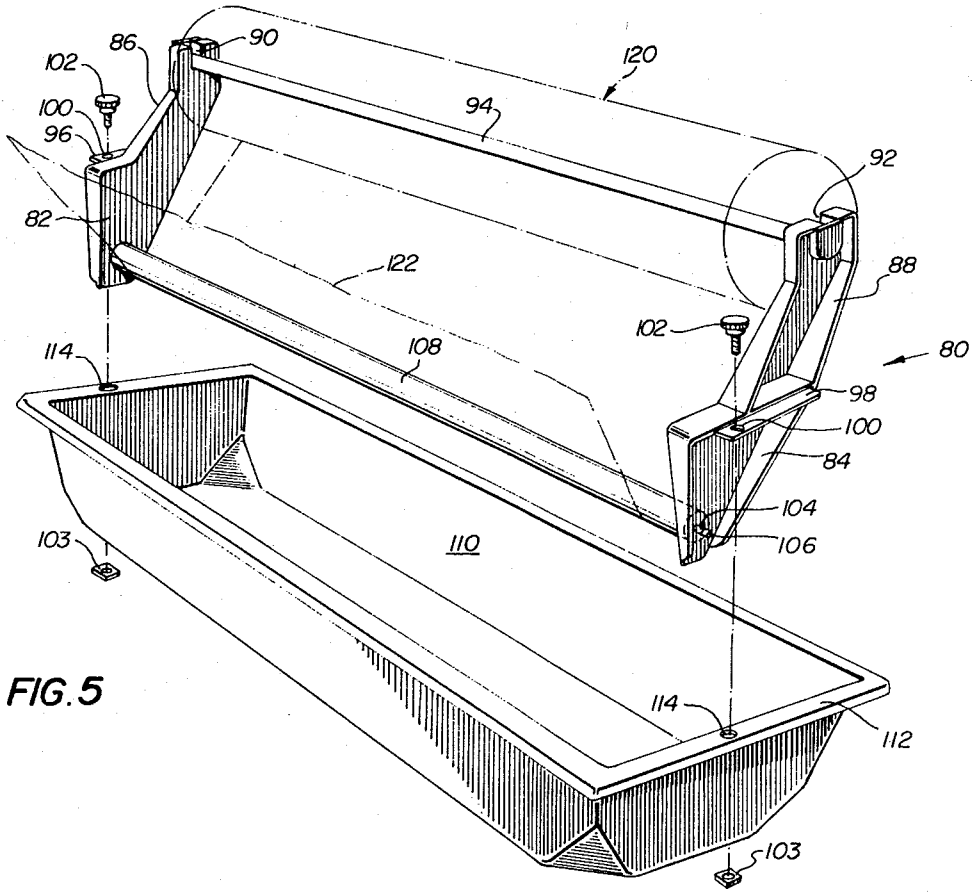

In the drawings which illustrate embodiments of the invention:

FIG. 1 is an exploded perspective view of the wall paper applying apparatus of this invention, FIG. 1A is a perspective view of an alternate roller assembly for use with the apparatus, FIG. 2 is a top plan view of the apparatus of FIG. 1 using the roller assembly of FIG. 1A, FIG. 3 is an end elevational view, partly in section of the apparatus of FIG. 1A, FIG. 4 is and end elevational view partly in section of the embodiment of the invention of FIG. 1 including a glue roll and a glue transfer roll for applying glue or paste and FIG. 5 is an exploded perspective view of an alternative embodiment.

Referring now in detail the the drawings wherein one embodiment of the wall papering apparatus is shown generally at 10 in FIGS. 1A and 3. The apparatus 10 includes a base 12 having a pair of upright flanges 14 and 16 secured thereto at opposed end edges. Slots or grooves 18 and 20 in the inner faces of each of the flanges 14 and 16 removably support a rod 22 which is in turn adapted to rotatably support a roll of wall paper 24 shown in broken lines in FIG. 3. It will be appreciated that the slots 18 and 20 allow the rod 22 to be lifted out so as to remove or install rolls of paper 24 and that a blind hole could be substituted for one of the slots 18 or 20.

A frame 26 fabricated of suitable material such as steel rod has a pair of legs 28 and 30 and an optional interconnecting portion 32. The free ends of the legs 28 and 30 are secured to the flanges 14 and 16 respectively by to studs 34 and 35 passing through suitable apertures in each leg of the frame 26 at least one stud 35 on each of the flanges 14 and 16 is threaded to receive quick release fastening means such as a butterfly nut 36.

The legs of the frame 26 are bent downwardly so as to extend into a trough 38 and support a first roller 40 of wood or plastic adjacent an upper edge of a wall 42 of the trough 38 and a second roller 44 near the bottom of the trough. The roller 40 and 44 are parallel to the rod 22 and are secured to the frame as by pins 46 thereon extending through suitable apertures in the legs 28 and 30.

In addition adjustable paper guides 50 and 52 are provided on either side of the roll of paper 24 so that the apparatus will accomodate various widths of wall paper.

In operation after having installed the roll of wall paper 24 and obtained a trough 38 partially filled with water, the frame 26 is removed by releasing wing nuts 36, the trough is positioned on the base 12 as shown in FIG. 3, and the frame 26 is replaced so that the lower roller 44 will be partially submerged in the water 56. The paper is then fed over the roller 40 and under the roller 44 where it is moistened for application to a wall.

It should be pointed out that a very convenient way of using the apparatus is to place it adjacent the base board or bottom of the wall. A length of paper is then drawn through the water in the trough and the upper end positioned at the ceiling. The lower end of the length of paper is then positioned and cut, assuming that the side edge has been correctly positioned. The apparatus is then moved along the wall and the procedure repeated.

The modified version of the apparatus of FIGS. 1A and 3 is shown generally at 60 in FIGS. 1 and 4. The apparatus 60 has been adapted to apply paste to wall paper. The base 12, flanges 14 and 16 for supporting a roll of unpasted wall paper 61 and the studs 34 and 35 have not been changed. However, a modified frame 62 has a pair of legs 64 which are bent downwardly into the trough 38 and upwardly again so as to define a V shape. This frame supports a roller 65 similar to the roller 40 described above and also supports a first roller 66 adjacent the upper edge of the wall of the trough 38, a second roller 68 adjacent the bottom of the V shaped legs and a third roller 70 adjacent the upper edge of the other wall of the trough 38. A glue transfer roller 72 is suspended above the roller 68 by a pair of brackets 74. Each of the brackets 74 is designed to hook over the edges of the trough 38 and has a substantially V shaped middle portion including an indentation to receive the stub shafts at the ends of the roller 72.

In operation the unpasted wall paper 61 is placed in the apparatus and a suitable amount of glue or paste 76 is provided in the trough 38. The paper 61 is threaded through the apparatus in the manner shown in FIG. 4 so that the paper passes over the roller 65, under the roller 66, over the roller 72 and under the roller 70. The required amount of paper is then withdrawn from the apparatus and applied to the wall in a manner similar to that described above with reference to FIG. 3. The paste or glue in the trough is transferred from the roller 68 to the roller 72 and then applied to the wall paper as the paper is withdrawn.

Alternatively the apparatus may be constructed as shown generally at 80 in FIG. 5. The apparatus 80 includes a pair of frame members 82 and 84 preferably molded of suitable plastic material and having upstanding flanges 86 and 88 provided with slots 90 and 92 respectively to receive ends of a rod or wooden dowel 94.

The flanges 86 and 88 have outwardly extending horizontal ribs 96 and 98 and each rib has an aperture 100 (only one of which is shown) through which bolts 102 extend.

An aperture 104 is provided in each of the frame members 82 and 84 adjacent lower ends thereof to receive centrally located stub shafts as pins 106 (only one of which is shown) secured in the ends of a roller 108.

An aperture 104 is provided in each of the frame members 82 and 84 adjacent lower end thereof centrally located to receive pins or stub shafts 106 (one of which is shown) secured in the ends of a roller 108. In order to provide a base for the apparatus 80 a wider trough 110 has been provided. The width is such that when wallpaper is withdrawn from the roll supported by the rod 94 the trough 110 will resist any tendency to tip. A rim 112 on the upper edge of the trough 110 provides regidity and has apertures 114 to receive the bolts 102 which in turn receive retaining nut 103. The roll of wallpaper 120 is rotatably supported by the rod 94 and paper 122 withdrawn from the roll 120 passes under the roller 108.

Operation of the apparatus 80 is almost identical to the apparatus 10 described above with reference to FIG. 3. As the paper 122 is withdrawn from the roll 120 it passes under the roller 108 and is moistened. It is therefore possible to withdraw only the amount required whereas with known devices it is necessary to cut a length of paper approximately the size required which is then passed through the trough of water. Usually the prior method resulted a waste of a significant amount of wallpaper.

I claim:

1. An apparatus for applying wall paper, said apparatus comprising, a base, spaced apart upright flanges on the base for holding a roll of wall paper with guide means attached thereto, frame members on the flanges extending into a trough positioned in front of said flanges, a first roller journaled on the members so as to extend along an upper edge of an adjacent side wall of the trough and a second roller journaled on a portion of said members extending into a lower portion of the trough, whereby a roll of wall paper supported for rotation on said flanges is fed over said first roller, under said second roller which is in the trough of water so that when a length of paper is withdrawn it is moistened and the leading portion can be applied to an uppermost portion of a wall, positioned, cut to length, and the procedure repeated as the apparatus is moved along the wall.

2. An apparatus for applying wall paper as claimed in claim 1 wherein said frame members extend upwardly from said lower portion of said trough so as to rotatably support a roll adjacent the upper edge of the trough opposite the first roll, said members also supporting a roll positioned between said first and second rolls and a pair of brackets removably positioned on said trough to support a transfer roll adapted to be in contact with said roll in the lower portion of said trough which is adapted to be provided with a supply of paste.

* * * * *